US010948262B2

(12) United States Patent
Curry et al.

(10) Patent No.: US 10,948,262 B2
(45) Date of Patent: Mar. 16, 2021

(54) FIREARM AND GRIP STRAP

(71) Applicant: Smith & Wesson Inc., Springfield, MA (US)

(72) Inventors: Brett Curry, Monson, MA (US); Gary Zukowski, Ludlow, MA (US)

(73) Assignee: Smith & Wesson Inc., Springfield, MA (US)

( * ) Notice: Subject to any disclaimer, the term of this patent is extended or adjusted under 35 U.S.C. 154(b) by 65 days.

(21) Appl. No.: 16/545,374

(22) Filed: Aug. 20, 2019

(65) Prior Publication Data

US 2020/0064101 A1 Feb. 27, 2020

Related U.S. Application Data

(60) Provisional application No. 62/721,911, filed on Aug. 23, 2018.

(51) Int. Cl.
*F41C 23/10* (2006.01)
*F41A 19/44* (2006.01)

(52) U.S. Cl.
CPC ..... *F41C 23/10* (2013.01); *F41A 19/44* (2013.01)

(58) Field of Classification Search
CPC ..... F41C 23/10; F41C 23/16; F41C 23/22; F41C 23/00; F41C 23/14; F41C 23/18; F41C 23/12; F41C 23/06; F41C 23/04; F41C 23/08; F41A 19/44; F41G 11/003
USPC .... 42/69.03, 70.02, 70.08, 71.01, 71.02, 72, 42/73, 74
See application file for complete search history.

(56) References Cited

U.S. PATENT DOCUMENTS

| | | | | |
|---|---|---|---|---|
| 3,242,607 | A * | 3/1966 | Tappehorn | F41A 19/53 42/65 |
| 3,503,149 | A * | 3/1970 | Hedges | F41A 17/74 42/65 |
| 4,313,272 | A * | 2/1982 | Matthews | F41G 11/001 42/115 |
| 4,313,273 | A * | 2/1982 | Matthews | F41G 11/001 42/117 |
| 4,680,884 | A * | 7/1987 | Smith, Jr. | F41A 17/46 42/66 |
| 5,743,039 | A * | 4/1998 | Garrett | F41A 17/04 42/42.03 |
| 6,530,306 | B1 | 3/2003 | LaFleur | |
| 7,143,538 | B2 | 12/2006 | LaFleur | |
| 7,299,581 | B2 | 11/2007 | LaFleur | |
| 7,467,489 | B2 | 12/2008 | Gussalli Beretta | |
| 7,506,469 | B2 | 3/2009 | Poulin et al. | |
| 7,861,449 | B1 * | 1/2011 | Zajk | F41A 3/66 42/62 |
| 2009/0044436 | A1 * | 2/2009 | Zajk | F41C 23/16 42/59 |
| 2014/0190053 | A1 * | 7/2014 | Zajk | F41C 3/14 42/65 |

FOREIGN PATENT DOCUMENTS

EP 0192343 A2 8/1986

* cited by examiner

*Primary Examiner* — Michael D David
(74) *Attorney, Agent, or Firm* — John A. Chionchio, Esquire; Ballard Spahr LLP

(57) ABSTRACT

A grip strap is removably attachable to a grip of a firearm using a plunger mounted in the grip and biased by a mainspring which also biases a hammer strut of the firearm.

7 Claims, 9 Drawing Sheets

FIREARM AND GRIP STRAP

CROSS REFERENCE TO RELATED APPLICATIONS

This application is based upon and claims benefit of priority to U.S. Provisional Application No. 62/721,911, filed Aug. 23, 2018 and hereby incorporated by reference herein.

FIELD OF THE INVENTION

This invention concerns interchangeable grip straps for firearms such as pistols and revolvers.

BACKGROUND

Most interchangeable grip straps require the use of fasteners in the form of screws, pins or types of pivoting or sliding removable fasteners to retain the grip strap to the firearm frame. Advantage would be realized if retention of the grip strap could be realized without the use of additional fasteners. This would allow the grip of a firearm to be easily modified by the removal and attachment of grip straps of different sizes to accommodate different sized hands.

SUMMARY

The invention concerns a firearm and a grip strap. In an example embodiment, the firearm comprises a frame defining a grip. A hammer strut is positioned within the grip. A cup is positioned within the grip. A mainspring is positioned within the grip and acts between the hammer strut and the cup. A plunger is mounted on the cup and extends through an opening in the grip. A grip strap is removably positionable on the grip. By way of example the grip strap comprises a strap portion overlying the frame. The strap portion has first and second ends oppositely disposed. A spur projects from the first end of the strap portion. The spur engages a recess in the frame. An aperture is positioned in the second end of the strap portion. The aperture receives the plunger. Engagement of the spur with the frame and the plunger with the aperture retains the grip strap to the grip.

In an example embodiment the aperture is defined by a lug projecting from the second end of the strap portion. In a specific example the lug comprises a ramp surface surrounding the aperture. The ramp surface faces the plunger when the grip strap is retained to the grip. Further by way of example, the firearm comprises a plate mounted on the grip. The plate defines the opening. In an example embodiment the plate has a plate surface facing the mainspring. The plate surface surrounds the opening and defines a line of motion along which the plunger moves, such that movement of the plunger toward the mainspring compresses the mainspring. In an example embodiment the mainspring comprises a coil spring surrounding an axis oriented parallel to the line of motion of the plunger. In a specific example, the axis is coaxially aligned with the line of motion.

The invention further encompasses a method of attaching a grip strap to a grip of a firearm. In one example embodiment the method comprises:

- engaging a spur extending from a first end of the grip strap with a recess in the grip;
- rotating the grip strap about the spur toward the grip;
- engaging an aperture positioned in a second end of the grip strap with a plunger extending from an opening in the grip;
- biasing the plunger into engagement with the aperture using a mainspring of a trigger strut positioned within the grip.

An example method of attaching a grip may further comprise moving the plunger toward the mainspring by engaging the plunger with a ramp surface mounted on a second end of the grip strap upon rotating the grip strap about the spur toward the grip.

The invention further encompasses a method of removing a grip strap from a grip of a firearm. In an example embodiment the method comprises:

- moving a plunger out of engagement with an aperture positioned in a second end of the grip strap by compressing a mainspring of a trigger strut positioned within the grip;
- rotating the grip strap away from the grip about a spur extending from a first end of the grip strap opposite the second end, the spur being engaged with a recess in the grip;
- removing the spur from engagement with the recess.

An example method of removing a grip strap may further comprise moving the plunger by inserting a tool into the aperture and engaging the plunger with the tool.

DETAILED DESCRIPTION

Figure 1:
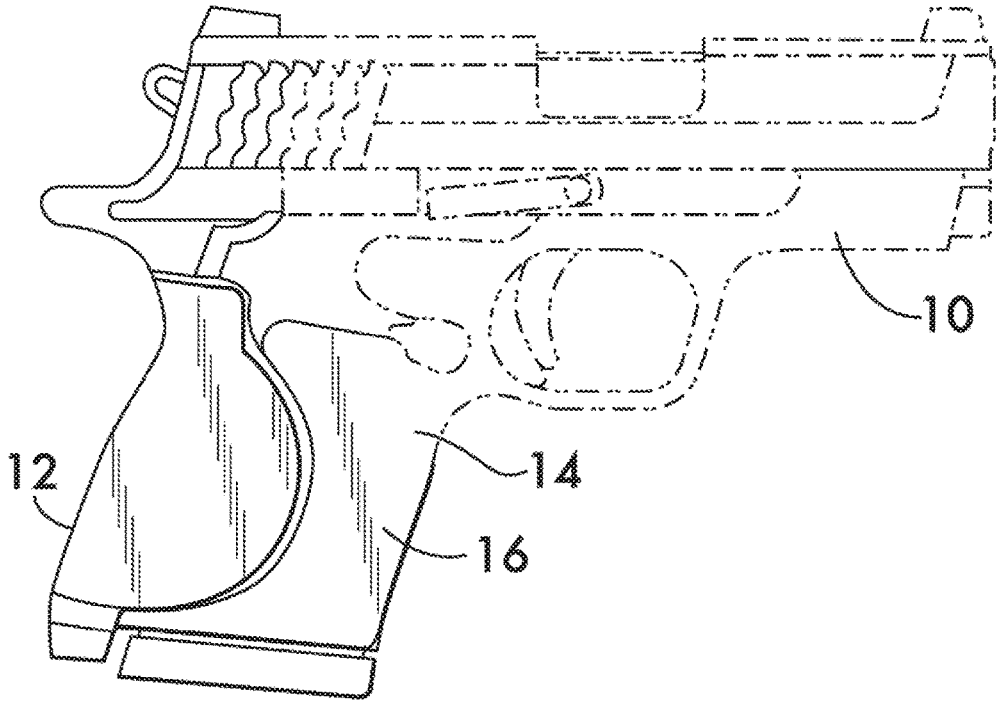
FIG. 1 is a side view of an example pistol and grip strap according to the invention.
Figure 2:
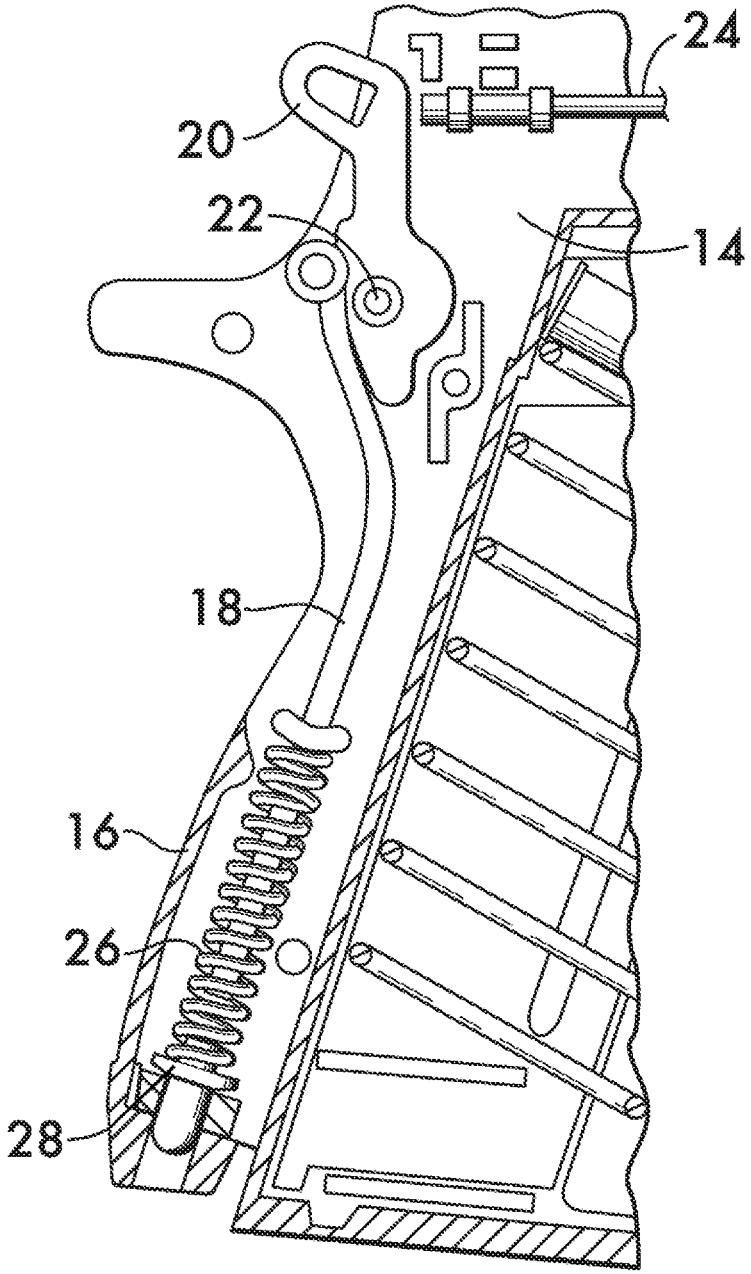
FIG. 2 is a partial sectional view of the pistol in FIG. 1.
Figure 3:
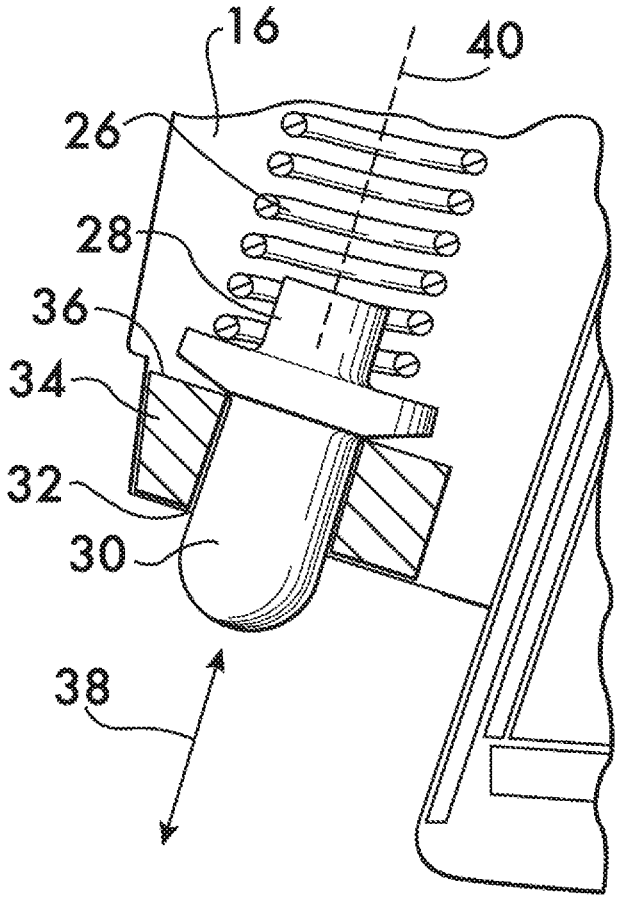
FIG. 3 is a detailed view of a portion of the pistol of FIG. 1 shown on an enlarged scale.

FIG. 1 shows an example firearm 10 and grip strap 12 according to the invention. In this example firearm 10 comprises a semiautomatic pistol having a frame 14 defining a grip 16. As shown in FIG. 2, a hammer strut 18 is positioned within the grip 16. The hammer strut 18 is pivotably connected to a hammer 20 which pivots about an axis 22 on frame 14 to strike a firing pin 24 to discharge firearm 10 when a trigger is pulled. The force necessary to pivot hammer 20 is provided by a mainspring 26. Mainspring 26 is positioned within grip 16 and acts between the hammer strut 18 and a cup 28, also positioned within the grip. Cup 28 helps to retain and stabilize mainspring 26 within the grip 16. As shown in FIG. 3, a plunger 30 is mounted on cup 28 and extends in a direction opposite to the mainspring 26 through an opening 32 in the grip 16. In this example embodiment, the opening 32 is defined by a plate 34 mounted on the grip 16. Plate 34 has a plate surface 36 which faces mainspring 26 and surrounds opening 32 to define a line of motion 38 along which plunger 30 moves. In this example embodiment, mainspring 26 comprises a coil spring surrounding an axis 40 which is coaxially aligned with the line of motion 38 of plunger 26. Motion of plunger 26 along the line of motion 38 toward the mainspring 26 compresses the mainspring, which biases both the plunger 30 and the hammer strut 18.

Figure 4:
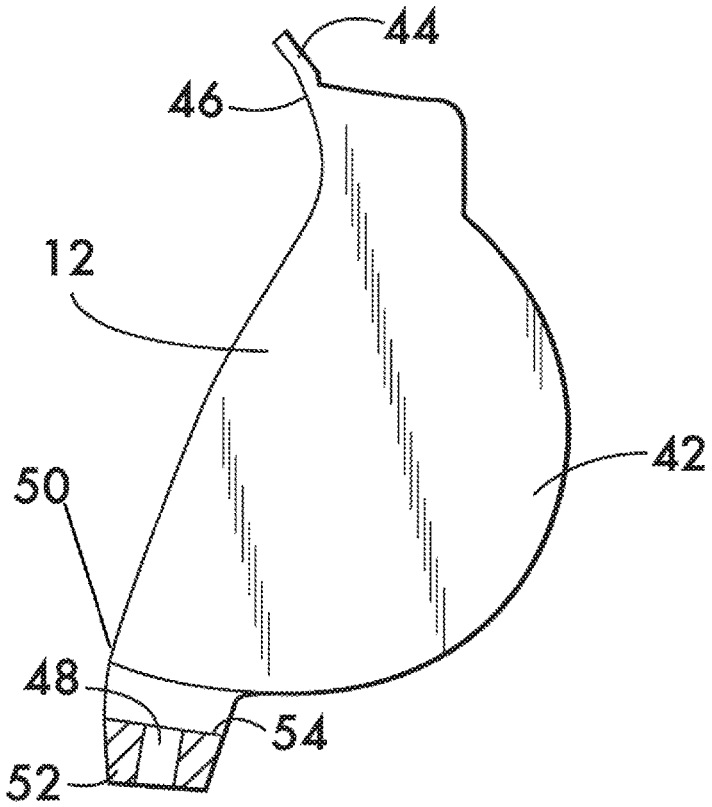
FIG. 4 is a side view of an example grip strap according to the invention.

FIG. 4 shows an example grip strap 12 which is removably positionable on grip 16. Grip strap 12 comprises a strap portion 42 which overlies the frame. A spur 44 projects from a first end 46 of the grip strap 12, and an aperture 48 is positioned in a second end 50 of the grip strap. In this example the aperture 48 is defined by a lug 52 which projects from the second end 50 of the grip strap 12. Lug 52 comprises a ramp surface 54 which faces the plunger 30 when the grip strap is positioned on the grip 16. Engagement of the spur 44 with frame 14 and the aperture 48 with the plunger 30 removably retain the grip strap 12 to the grip 16 as described below.

Figure 5:
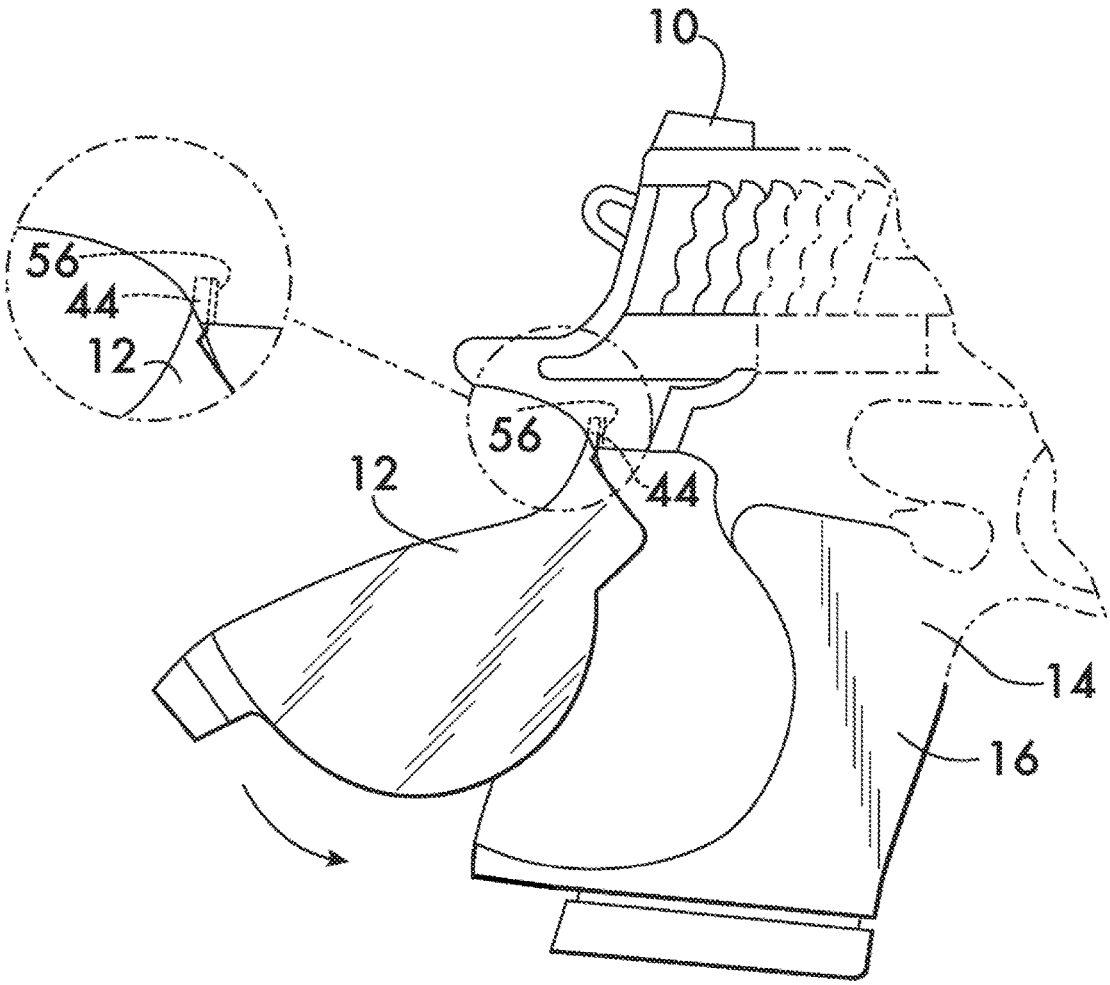
FIGS. 5, 6 and 7 illustrate an example method of attaching a grip strap to a pistol.
Figure 6:
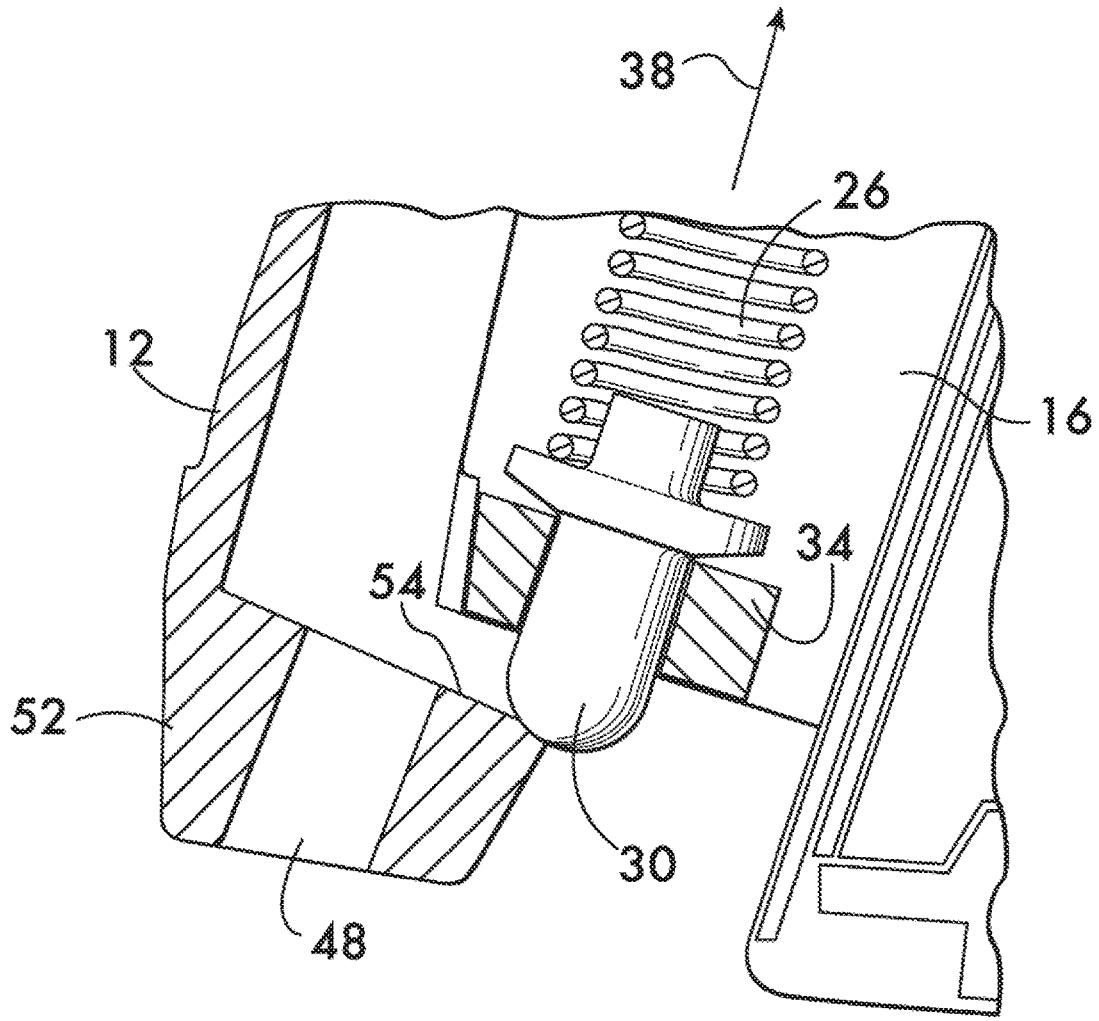
Figure 7:
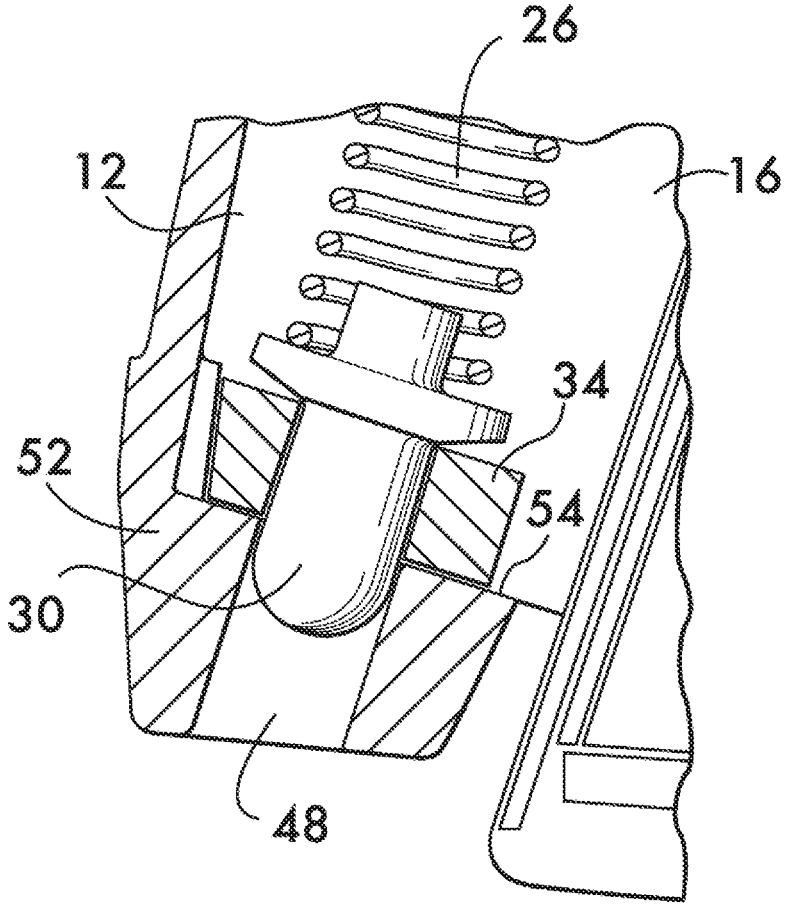

FIGS. 5-7 illustrate an example method according to the invention of attaching the grip strap 12 to the firearm 10. As shown in FIG. 5, grip strap 12 is positioned such that the spur 44 engages a recess 56 in the grip 16. Grip strap 12 is then rotated about spur 44 toward the grip 16. As shown in FIG. 6, lug 52 is positioned such that upon rotation of the grip strap 12, the ramp surface 54 engages plunger 30 and moves the plunger along the line of motion 38, compressing the biasing mainspring 26. As shown in FIG. 7, once the aperture 48 aligns sufficiently with the plunger 30 the mainspring 26 biases the plunger into engagement with the aperture. The plunger 30 and lug 52 cooperate with the spur 44 and recess 56 to securely retain the grip strap 12 to the grip 16.

Figure 8:
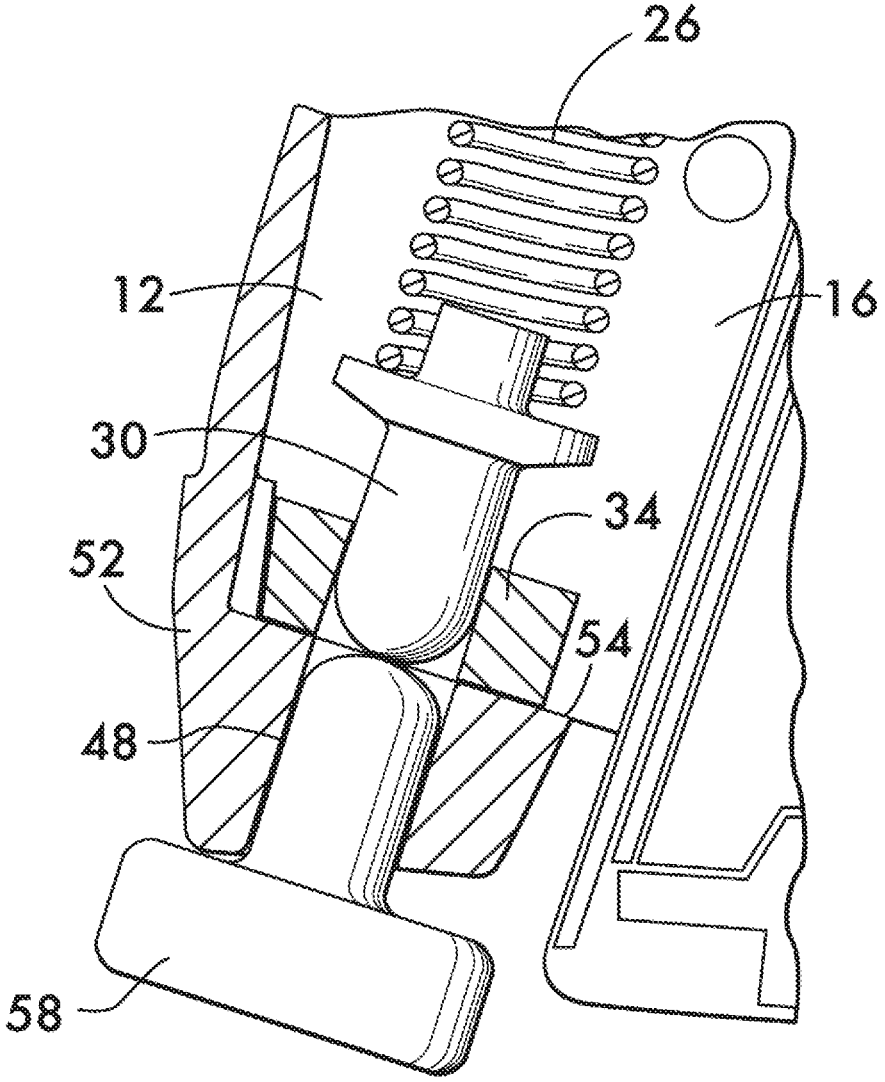
FIGS. 8, 9 and 10 illustrate an example method of removing a grip strap from a pistol.
Figure 9:
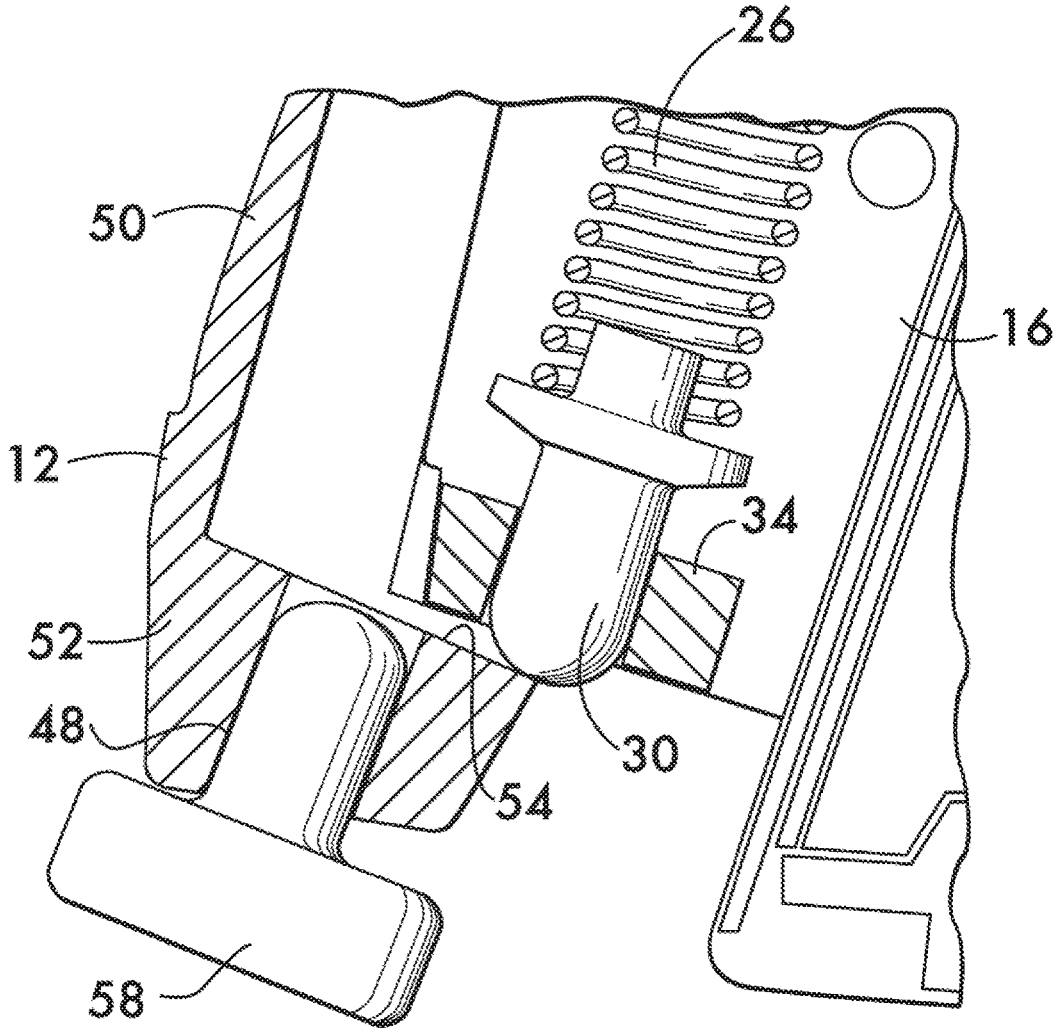
Figure 10:
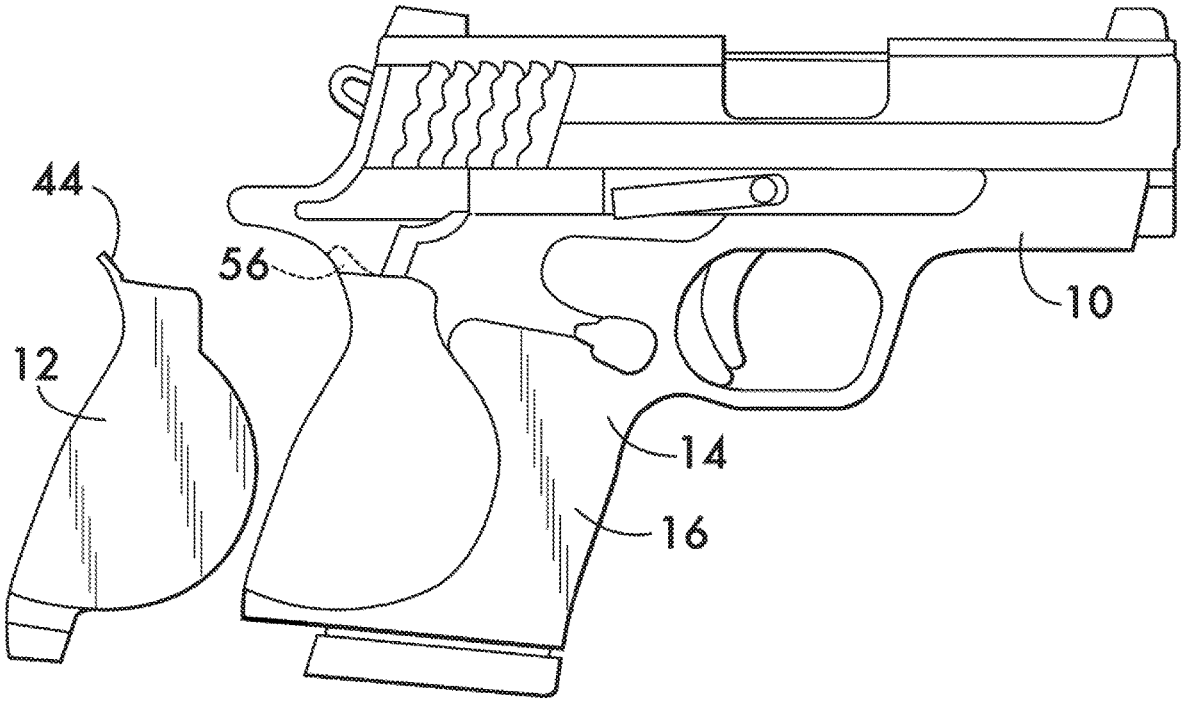

FIG. 8-10 illustrate an example method according to the invention for removing the grip strap 12 from the firearm 10. As shown in FIG. 8, a tool 58 is inserted into the aperture 48 of lug 52 sufficient to move the plunger 30 against the biasing force of mainspring 26 and out of engagement with the aperture. As shown in FIG. 9, the grip strap 12 may now be rotated away from the grip 16 to disengage the second end 50 of the grip strap from the grip 16. Both the tool 58 and the plunger 30 may have rounded heads to permit easy relative motion between the grip strap and the grip. As shown in FIG. 10, the spur 44 is next disengaged from recess 56 to remove the grip strap 12 from the grip 16.

It is expected that the firearm and grip strap according to the invention, which uses the hammer strut mainspring to bias the plunger as well as the hammer strut, will provide a simpler way to modify the grip of a firearm to accommodate different users by allowing easy substitution of different sized grip straps to fit different sized hands.

What is claimed is:

1. A firearm, said firearm comprising:

a frame defining a grip;

a hammer strut positioned within said grip;

a cup positioned within said grip;

a mainspring positioned within said grip and acting between said hammer strut and said cup;

a plunger mounted on said cup and extending through an opening in said grip;

a grip strap removably positionable on said grip, said grip strap comprising:

a strap portion overlying said frame, said strap portion having first and second ends oppositely disposed;

a spur projecting from said first end of said strap portion, said spur engaging a recess in said frame;

an aperture positioned in said second end of said strap portion, said aperture receiving said plunger, engagement of said spur with said frame and said plunger with said aperture retaining said grip strap to said grip.

2. The firearm according to claim 1, wherein said aperture is defined by a lug projecting from said second end of said strap portion.

3. The firearm according to claim 2, wherein said lug comprises a ramp surface surrounding said aperture, said ramp surface facing said plunger when said grip strap is retained to said grip.

4. The firearm according to claim 1, further comprising a plate mounted on said grip, said plate defining said opening.

5. The firearm according to claim 4, wherein said plate has a plate surface facing said mainspring, said plate surface surrounding said opening and defining a line of motion along which said plunger moves, such that movement of said plunger toward said mainspring compresses said mainspring.

6. The firearm according to claim 5, wherein said mainspring comprises a coil spring surrounding an axis oriented parallel to said line of motion of said plunger.

7. The firearm according to claim 6, wherein said axis is coaxially aligned with said line of motion.

* * * * *